US007008909B2

(12) United States Patent
Burgo et al.

(10) Patent No.: US 7,008,909 B2
(45) Date of Patent: Mar. 7, 2006

(54) ALPHA BRANCHED ESTERS FOR USE IN METALWORKING FLUIDS AND METALWORKING FLUIDS CONTAINING SUCH ESTERS

(75) Inventors: Rocco Burgo, Mullica Hill, NJ (US); Paul Kennedy, Bensalem, PA (US)

(73) Assignee: Inolex Investment Corporation, Wilmington, DE (US)

( * ) Notice: Subject to any disclaimer, the term of this patent is extended or adjusted under 35 U.S.C. 154(b) by 221 days.

(21) Appl. No.: 10/397,448

(22) Filed: Mar. 26, 2003

(65) Prior Publication Data

US 2004/0072703 A1 Apr. 15, 2004

Related U.S. Application Data

(60) Provisional application No. 60/417,957, filed on Oct. 11, 2002.

(51) Int. Cl.
*C10M 173/00* (2006.01)
*C10M 129/70* (2006.01)

(52) U.S. Cl. ..... 508/463; 72/42

(58) Field of Classification Search ..... 508/463; 560/129; 554/1

See application file for complete search history.

(56) References Cited

U.S. PATENT DOCUMENTS

| | | | | |
|---|---|---|---|---|
| 3,526,596 | A | 9/1970 | Kress et al. | |
| 3,720,695 | A | 3/1973 | Meisters | |
| 4,108,785 | A | 8/1978 | Sturwold | |
| 4,166,151 | A * | 8/1979 | Jahnke | 428/457 |
| 4,172,802 | A | 10/1979 | Rieder | |
| 4,243,357 | A | 1/1981 | Flynn et al. | |
| 4,359,393 | A | 11/1982 | Sturwold | |
| 4,601,838 | A | 7/1986 | Kammann, Jr. et al. | |
| 4,606,833 | A | 8/1986 | Schuettenberg et al. | |
| 4,632,770 | A | 12/1986 | Slanker | |
| 4,803,010 | A * | 2/1989 | Ogino et al. | 510/422 |
| 4,830,768 | A * | 5/1989 | Reich et al. | 508/505 |
| 4,830,769 | A | 5/1989 | O'Lenick, Jr. et al. | |
| 4,846,991 | A * | 7/1989 | Suzue et al. | 424/70.19 |
| 4,882,077 | A | 11/1989 | Cox | |
| 5,091,270 | A * | 2/1992 | Ohya et al. | 428/694 BG |
| 5,171,481 | A * | 12/1992 | Yoshimura et al. | 508/463 |
| 5,248,431 | A | 9/1993 | Fujita et al. | |
| 5,318,711 | A * | 6/1994 | Evans et al. | 508/485 |
| 5,322,633 | A * | 6/1994 | Senaratne et al. | 508/496 |
| 5,744,432 | A | 4/1998 | Barnhorst et al. | |
| 6,008,167 | A * | 12/1999 | Appelman et al. | 508/463 |
| 6,300,293 | B1 | 10/2001 | Lamberth | |
| 6,710,021 | B1 * | 3/2004 | Fisher | 508/152 |
| 6,881,859 | B1 * | 4/2005 | Mozeleski et al. | 560/265 |

OTHER PUBLICATIONS

Burgo, et al., "Metalworking's Watery Challenge," Lubes'N'Greases, p. 31 (Oct., 2001).

* cited by examiner

*Primary Examiner*—Ellen M. McAvoy
(74) *Attorney, Agent, or Firm*—Flaster/Greenberg P.C.

(57) ABSTRACT

Alpha branched esters for use in a metalworking fluid represented by the formula (I):

(I)

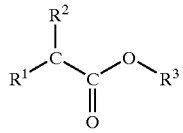

wherein $R^1$, $R^2$, and $R^3$ are each independently selected from a hydrocarbon group having one to thirty-six carbon atoms are described. The hydrocarbon groups may be independently an alkyl group, an alkenyl group, an aryl group, or an allyl group; substituted or unsubstituted; branched, cyclic, or linear. Also provided are metalworking concentrates comprising the alpha branched ester, as described above, and, optionally, a hydrocarbon oil, as well as metalworking fluids including water, and the alpha branched esters of the invention. The invention also includes methods of preparing the metalworking fluid and composition of the invention, as well as methods of improving the operating life of the fluid or composition.

15 Claims, No Drawings

ALPHA BRANCHED ESTERS FOR USE IN METALWORKING FLUIDS AND METALWORKING FLUIDS CONTAINING SUCH ESTERS

REFERENCE TO RELATED APPLICATION

This application claims priority under 35 U.S.C. § 119(e) to U.S. Provisional Patent Application Ser. No. 60/417,957, filed Oct. 11, 2002, the contents of which are incorporated herein by reference.

BACKGROUND OF THE INVENTION

Metalworking involves the cutting or shaping of metal parts in various machining applications such as drilling, milling, turning, grinding, boring, cutting, tapping, stamping, sawing, and drawing. As part of these operations, metalworking fluids are employed to ensure that these machining operations are accomplished in an efficient manner. Metalworking fluids provide lubricity to reduce or overcome the friction that occurs as cutting tools contact the metal workpiece. They are also needed to provide cooling, in order to negate the deleterious effects of the tremendous amount of heat generated during metalworking processes. Use of metalworking fluids also facilitates prevention of the cutting tool from adhering to the metal workpiece, protection against corrosion, and removal of metal swarf from the machining area.

In conventional practice, prior art esters have been used as additives in various types of lubricant and/or metalworking fluids to provide lubricity and anti-wear characteristics, thereby enhancing the performance of the fluid. For example, it is known to use certain polyhydric alcohol esters of an aliphatic acid as a lubricity additive in a metal forming fluid. Similarly, a polyester of a dimeric acid which is either water soluble or readily emulsifiable has been used as a lubricity additive in the preparation of water-based stamping lubricants. A specific, high molecular weight polyester prepared from a polyalkylene glycol and a polycarboxylic acid has been employed as a lubricity additive in a fluid used in the manufacture and surface treatment of metallic pipe, wire, and sheet. Specific esters derived from $C_6$ to $C_{20}$ monobasic or dibasic acids and $C_6$ to $C_{20}$ primary, secondary or tertiary alcohols or blend of such alcohols have been used as lubricity additives in fluids employed for the production of two-piece metal cans. Alkoxylated Guerbet alcohols and esters for use as lubricants are also known for use in fluids.

As is known in the art, those metalworking fluids that are water-dilutable must typically be employed at a pH of about 7 to about 10 in order to prevent corrosion of the metal of the cutting tool(s) and/or of the workpiece. This alkaline pH is also necessary as a means of controlling and/or minimizing growth of microbiological organisms, which destabilize conventional metalworking fluids, thereby severely curtailing the fluid's operating life.

Unfortunately, most esters are readily decomposed (by hydrolysis and/or other chemical mechanisms) under the alkaline pH conditions in which metalworking processes are carried out. When such decomposition occurs, the effectiveness of the conventional esters as lubricity additives to the metalworking fluids is significantly degraded and the operating life of the fluid is curtailed. This is a shortfall of known prior art esters used as additives in metalworking fluids. For example, when the conventional esters added to a metalworking fluids undergo hydrolysis, the overall acidity of the metalworking fluid is increased, leading to a greater chance of corrosion of the cutting tools and/or the metal workpieces being worked. An additional concern associated with hydrolytic degradation is the generation of water-insoluble salts that can produce undesirable residues on metal parts, further destabilize the metalworking fluid, and clog the filtration systems used to maintain/recycle these fluids. Deleterious odors can also result from the decomposition of esters which can adversely affect the manufacturing environment, and increase costs by necessitating operation or installation of ventilation systems.

Attempts at devising esters that exhibit varying degrees of hydrolytic stability under various conditions have been described in the art. For example, alkanoic acid esters of cyclohexane dimethanol are used as chlorine-free extreme pressure additives. The synthesis of certain cyclohexyl esters which provide lubricity in metal-metal surface contact systems is also known. Alpha branched carboxylic acids has been described as effective lubricants in chlorine-free fluorocarbon refrigerant heat transfer fluids, particularly for the refrigerant R134a, but not as metalworking fluid lubricant.

Additionally, alkanoic acid esters derived from alpha branched carboxylic acids have been known in the prior art as useful lubricant basestocks and lubricity additives. For example, the use of polyol esters derived from five to ten carbon-containing branched and linear acids as synthetic biodegradable lubricants and functional fluids has been described, as has the preparation of certain alpha branched esters in which the two carbon chains of the alpha branched carboxylic acid contain from ten to forty-two carbon atoms, wherein each carbon chain ranges from four to twenty-two carbon atoms. These carboxylic acids can be reacted with a variety of diols and polyols to form esters which may be used as lubricant basestocks.

The use of a series of alpha branched carboxylic acid esters as lubricity additives in mold release agents which are applied either neat or as oil-in-water emulsions is known. Other researchers have disclosed the preparation of polyol ester lubricant basestocks based on linear and alpha branched carboxylic acids (such as 2-ethylhexanoic acid) combined with a small percentage of a second alpha branched carboxylic acid, isopalmitic acid.

The preparation of polyol ester blends containing specific alpha branched carboxylic acids and straight chain fatty acids which are suitable for use as hydraulic fluids and lubricant basestocks has been described. The total number of alkyl groups in the disclosed alpha branched carboxylic acid ranges from $C_{14}$ to $C_{22}$ and each branch can contain from $C_1$ to $C_{19}$ alkyl groups. Additionally, lubricant and power transmission fluids that are prepared in part from the 1,6-hexanediol diester of an alpha branched carboxylic acid (2-ethylhexanoic acid) are known. Also described in the prior art is the synthesis of specific decahydronaphthalene dimethanol esters which are especially useful as high temperature lubricants.

There remains a need for a hydrolytically stable ester which can provide lubricity over longer time intervals in a metalworking fluid, thereby improving the performance of and/or extending the operating life of such fluids. Such esters would enable the preparation of metalworking fluids that exhibit excellent performance over a longer operating life, thereby reducing costs while maintaining or improving the performance of the metalworking fluid over a longer period of time.

BRIEF SUMMARY OF THE INVENTION

The invention as described herein provides alpha branched esters for use in a metalworking fluid, metalworking concentrates containing the alpha branched esters, metalworking fluids containing the alpha branched esters and which can be made using the metalworking concentrates, and methods of preparing and using such esters, compositions and fluids. In particular, the invention includes an alpha branched ester for use in a metalworking fluid wherein the ester is represented by the formula (I):

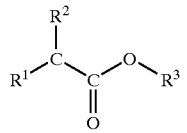

(I)

wherein $R^1$, $R^2$, and $R^3$ are each independently selected from a hydrocarbon group having one to thirty-six carbon atoms. The hydrocarbon groups may be independently an alkyl group, an alkenyl group, an aryl group, or an allyl group; substituted or unsubstituted; branched, cyclic, or linear.

Also included are metalworking concentrates comprising the alpha branched ester, as described above, and, optionally, a hydrocarbon oil, as well as metalworking fluids including water, and the alpha branched esters of the invention.

The invention also includes methods of preparing the metalworking fluid and composition of the invention, as well as methods of improving the operating life of the fluid or composition.

DESCRIPTION OF THE INVENTION

Industrial processes for metal machining customarily use a fluid that lubricates and cools the tool and workpiece. Such fluids are referred to in the art as "metalworking fluids" or "MWFs." The more common of metalworking fluids are water-based emulsions of lubricating oils. The lubricating oils utilized often consist of combinations of oils (mineral, vegetable, and/or animal-derived) with compounds such as esters that enhance lubricating properties. As discussed above, typical esters are prone to hydrolyze in the aqueous system of the metalworking fluid, limiting the time the fluid can be kept in service.

The present invention addresses this problem by providing hydrolytically stable alpha-branched esters for use in metalworking fluids. When used as an additive in metalworking fluids or metalworking fluid compositions, the hydrolytically stable alpha branched esters of the invention provide a longer operating life in metalworking fluids as compared to operating fluids having conventional esters, particularly in water-dilutable or water-based metalworking fluids, while at the same time maintain or improve the anti-wear and/or lubricity properties of the metalworking fluids. The invention also relates to metalworking concentrates which can be dilutable by water or other aqueous solutions to form metalworking fluids, processes for preparing the hydrolytically stable alpha branched esters of the invention, metalworking fluids containing such esters, and methods of improving the service life of a fluid for use in metalworking.

The hydrolytically stable alpha branched esters of the invention can be used in metalworking fluid(s) employed in any type of metalworking processes, such as, for example, drilling, milling, turning, grinding, boring, cutting, tapping, stamping, sawing, hot or cold rolling, and drawing, applied to any type of metal, such as, for example, carbon steels, alloy steels, stainless steels, aluminum and aluminum alloys, copper and copper alloys, brass, zinc and zinc alloys, bronze, titanium and titanium alloys, nickel and nickel alloys, and cast or wrought iron. Additionally, the esters can be used as lubricant additives in other aqueous-based fluids used in similar friction-generating operations.

Chemists have long understood that compounds containing ester linkages are formed by reacting a carboxylic acid with an alcohol. Water is a byproduct of this esterification reaction. The general esterification reaction is reversible, as is shown in the reaction pathway below:

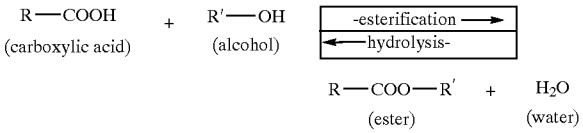

The reverse reaction is hydrolysis. Thus, hydrolysis is the breaking down of the ester in the presence of water to produce a carboxylic acid and an alcohol. Therefore, an ester is "hydrolytically stable" if it is resistant to the hydrolysis reaction and is consequently more stable in the presence of water.

The occurrence or non-occurrence of hydrolysis within a given system (and therefore the hydrolytic stability of the components of the system) can be monitored in several ways, as is known in the art. One method is to measure the amount of carboxylic acid in a sample before and after aging. The carboxylic acid concentration can be evaluated either by direct titration with strong base, or as a function of the decrease in pH of an aqueous system.

One standard titration method for carboxylic acid is American Oil Chemists Society (AOCS) Method Ca 5a-40, which is incorporated herein by reference. The AOCS method entails obtaining an acid value by titrating the ester with a strong base such as sodium hydroxide and potassium hydroxide to an endpoint of around pH 7 with, for example, phenolphthalene or a pH meter. The 'acid number" or "acid value" obtained is expressed as milligrams of potassium hydroxide (KOH) required to titrate a gram of sample to neutrality. All acid values discussed herein are expressed as mg KOH/g.

It has been determined that the specific esters of the invention, derived from alpha branched carboxylic acids, display good hydrolytic stability, both when 'neat' and when combined into a metalworking fluid. This beneficial hydrolytic stability of the esters of the present invention, as described herein, allows the formulation of metalworking fluids with enhanced operating life as compared to metalworking fluids containing typical esters, and maintains or improves the anti-wear and/or lubricity properties of the metalworking fluid.

The alpha branched esters of the invention are represented by the formula (I):

(I)

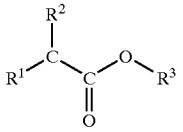

wherein $R^1$, $R^2$, and $R^3$ are independently selected from a hydrocarbon group having about one to about thirty-six carbon atoms, preferably about one to about nineteen carbons atoms, and most preferably about one to about ten carbons atoms. The selected hydrocarbon group(s) of $R^1$, $R^2$, and/or $R^3$ may be linear (aliphatic), branched, or aromatic, substituted or unsubstituted and may be saturated or unsaturated (i.e., may be independently aryl groups, alkyl groups, alkenyl groups, and/or allyl groups).

As used herein, "substituted" means an organic or hydrocarbon structure in which one or more of the bonds or atoms is replaced by a substituent group, such as a linear or branched functional group, alkyl groups, ionic groups, halogen atoms, and the like.

In one embodiment, $R^1$ and $R^2$ are each independently selected from a substituted, unsubstituted, branched or linear hydrocarbon group, preferably an alkyl group, having about one to about nineteen carbon atoms and $R^3$ is a substituted, unsubstituted, branched or linear hydrocarbon group, preferably an alkyl group, having about one to about thirty-six carbon atoms.

It may be preferred that the hydrocarbon group $R^1$ has about one to about ten carbon atoms, with an $R^1$ group having about one to about two carbon atoms being most preferred. With respect to the hydrocarbon group that is $R^2$, it may be preferred that it has about three to about twenty carbon atoms, with an $R^2$ group that has about five to about eight carbon atoms being more preferred and an $R^2$ group having about six carbon atoms being most preferred.

In another embodiment, the hydrocarbon groups of $R^1$ and $R^2$ together form a hydrocarbon ring structure. The ring structure may be saturated or unsaturated and/or substituted or unsubstituted. It is preferred that the ring structure has about two to about thirty carbons atoms and more preferred that it has about five to about twenty carbon atoms.

With respect to the hydrocarbon group $R^3$, it is preferred that it has about three to about twenty-four carbon atoms, and more preferred that it have about six to about eighteen carbon atoms.

The hydrolytically stable alpha branched esters of the invention may be prepared by any reaction pathway known or to be developed in the art. For example, they may be formed by the reaction of an alpha branched carboxylic acid and a fatty alcohol under typical ester synthesis conditions. As starting materials for the preparation of the hydrolytically stable alpha branched esters of the invention, one may use any alpha branched carboxylic acid and any fatty alcohol known or to be developed in the art, as long as the resultant ester has a structure as described by the formula (I) above.

Exemplary alpha branched carboxylic acids for use in the preparation of the hydrolytically stable alpha branched acid esters of the invention include, but are not limited to: iso-stearic acid, iso-myristic acid and iso-palmitic acid (commercially available from Nissan Chemical Industries, Ltd. of Tokyo, Japan); 2-n-butyl n-octanoic acid; 2-n-heptyl n-undecanoic acid; 2-n-octyl n-dodecanoic acid; 2-n-hexyl n-decanoic acid (iso-palmitic acid); 2-ethyl hexanoic acid; neopentanoic acid (pivalic acid); neoheptanoic acid; neononanoic acid; and neodecanoic acid or mixtures of such acids. A preferred alpha branched carboxylic acid is ethyl hexanoic acid.

The selected alpha branched carboxylic acid used in the practice of the invention may be purchased commercially, or may be prepared by methods as is known or to be developed in the art. For example, the Koch reaction or other non-specific synthesis routes yield mixtures of alpha branched carboxylic acids, the precise structures of which depend on the feedstock and reaction conditions, and which can be used in the practice of the invention.

Exemplary fatty alcohols for use in the invention include linear and branched (Guerbet) fatty alcohols, either short chain or long chain. Linear fatty alcohols useful in the practice of the invention include, but are not limited to: 1-hexanol (caproic alcohol); 1-heptanol (enanthic alcohol); 1-octanol (caprylic alcohol); 1-nonanol (pelargonic alcohol); 1-decanol (capric alcohol); 1-dodecanol (lauryl alcohol); 1-tetradecanol (myristyl alcohol); 1-hexadecanol (cetyl alcohol); 1-octadecanol (stearyl alcohol); 1-eicosanol (arachidyl alcohol); 1-docosanol (behenyl alcohol); 1-tetracosanol and 1-hexacosanol. Fatty alcohols such as those listed above may be obtained commercially, from, for example, Condea Vista Company, Houston, Tex., United States of America, under the trade names ALFOL® 6, ALFOL® 8, ALFOL® 10, ALFOL® 12, ALFOL® 14, ALFOL® 16, ALFOL® 18, ALFOL® 1012HA, ALFOL® 1014CDC, ALFOL® 1214, ALFOL® 1216, ALFOL® 1218, ALFOL® 1412, ALFOL® 1416GC, ALFOL® 1418DDB, ALFOL® 1618, and ALFOL® 20+.

Branched fatty alcohols that may be used in the invention include, but are not limited to: 2-butyl octanol; 2-butyl decanol; 2-hexyl octanol; 2-hexyl decanol; 2-octyl decanol; 2-hexyl dodecanol; 2-octyl dodecanol; 2-decyl tetradecanol; 2-dodecyl hexadecanol; 2-tetradecyl octadecanol; 2-tetradecyl eicosanol; 2-hexadecyl octadecanol; and 2-hexadecyl eicosanol. Such branched fatty acids may be obtained commercially from, for example, Condea Vista Company, Houston, Tex., United States of America, under the trade names ISOFOL® 12, ISOFOL® 14T, ISOFOL® 16, ISOFOL® 18T, ISOFOL® 18E, ISOFOL® 20, ISOFOL® 24, ISOFOL® 28, ISOFOL® 32, ISOFOL® 34T, and ISOFOL® 36.

Also included within the scope of the invention are metalworking concentrates for use in metalworking fluids and the metalworking fluids containing the ester or esters of the invention as described above. The metalworking concentrates of the invention include the hydrolytically stable alpha branched esters of the invention, optionally, a hydrocarbon oil, and, optionally, other additives (each of which is described in further detail infra).

The metalworking concentrates of the invention include the hydrolytically stable alpha branched ester of the invention. It is preferred that the ester is present in the metalworking concentrate in an amount of about 1% to about 90% of the total metalworking concentrate, with an amount of about 5% by weight to about 70% by weight of the total metalworking concentrate being more preferred.

The metalworking concentrate may contain, for example, water and hydrocarbon oil which may be, for example, a synthetic or a non-synthetic hydrocarbon oil. Suitable non-synthetic or synthetic oils for use in the metalworking concentrate and/or metalworking fluid of the invention may include, for example, mineral oils, vegetable oils, and/or animal-derived oils. Examples include, without limitation, walnut oil, cashew nutshell oil, olive oil, corn oil, peanut oil, grape seed oil, oiticia oil, rapeseed oil, animal-derived oils, such as fish oil; fish liver oil; sperm oil; oleic acid; bear oil; and whale oil; petroleum oil, paraffin oil, linseed oil, and stearic acids, engine oils, napthenic oil, white oil, polyolefinic oil, solvent refined oil, and cutting oils.

The selected oil or oils may be present in the metalworking concentrate in an amount of about 0 to about 90% by weight of the total metalworking concentrate, with an amount of 0 to about 80% by weight of the concentrate preferred.

The metalworking fluids of the invention may be prepared using the metalworking concentrates of the invention. The metalworking concentrates may be used "as-is" or may be dilutable with water or an aqueous solution. Formulations of the metalworking fluids of the invention also include all those known water-based fluids or water-dilutable fluids formulated as is known or to be developed in the art, with the exception that the alpha branched ester of the invention is incorporated therein.

If a metalworking fluid is prepared using the hydrolytically stable alpha branched esters of the invention, the fluid may contain water or any other aqueous solution. Water may be present in an amount of about 70% to about 99% by weight of the total metalworking fluid, preferably about 80% to about 90% by weight of the total fluid.

In preparing the metalworking fluid of the invention, additional additives to alter and/or adjust the properties of the fluid or composition may be included. Such additives any include any known or to be developed in the art. For example, the metalworking fluid formulation of the invention may include emulsifying agents; corrosion inhibitors, such as alkaline and alkanolamine salts of organic acids, sulfonates, amines, amides, organic borate compounds; biocides, such as, for example, o-phenylphenol, bactericides, fungicides, and algaecides; colorants; fragrances; agents that alter viscosity; buffers; solubilizers; anti-oxidants; anti-foaming agents; and extreme pressure additives. One or more of the additives can be added to the metalworking fluid of the invention, depending on the end use contemplated and the properties desired in the final formulation.

The metalworking concentrates of the invention may also include additives, as described above, if desired.

EXAMPLE 1

Theoretical Determination of Acid- and Base-Catalyzed Rate Constants to Evaluate Hydrolytic Stability of the Alpha Branched Esters of the Invention In general, many theoretical and/or empirical methods of evaluating the hydrolytic stability of esters are known in the art. For example, the hydrolytic stability of alpha branched esters can be modeled theoretically using modeling software that analyses the structure of a specific chemical to estimate the acid- and base-catalyzed rate constants.

An example of such software is Hydrowin software, developed by the United States Environmental Protection Agency and Syracuse Research Corporation. Hydrowin estimates the aqueous hydrolysis rate constant of a specific chemical at 25° C. using group contribution theory and is particularly useful for determining the hydrolysis rate of esters by acid and base catalysis. Using Hydorwin, it can be theoretically demonstrated that an alpha branched ester made in accordance with the invention, such as an ethyl branched isomer of an ester of lauryl alcohol and an eight carbon carboxylic acid, will have a half life of almost forty times longer than a non-branched conventional ester, as is shown in Table I below:

TABLE I

| Acid | Alcohol | Total Carbons | Half Life* (years at 25° C.) | Comments |
|---|---|---|---|---|
| n-octanoic | lauryl | 20 | 9.3 | no alpha branch |
| 2-methyl heptanoic | lauryl | 20 | 13.3 | methyl alpha branch |
| 2-ethyl hexanoic | lauryl | 20 | 354 | ethyl alpha branch |
| oleic | isopropyl | 21 | 10.3 | prior art ester considered by artisans to have good hydrolytic stability |

*Hydrowin software, version 1.67, available from SRC, Syracuse, New York, U.S.A.

EXAMPLE 2

To illustrate the hydrolytic stability of the alkanoic acid esters of the invention, for use as additives in metalworking fluids, an analysis was conducted as described in Examples 3–6. The esters tested in Examples 3–6, the designations by which each ester is referred herein, and the number of carbons present in each ester are shown in Table II below.

TABLE II

| Esters | Designation | Number of carbons |
|---|---|---|
| Methyl lardate | MES | 19 |
| Isopropyl oleate | IPO | 21 |
| Lauryl 2-ethyl hexanoate | LEH | 20 |
| Palmyl 2-ethyl hexanoate | PEH | 24 |
| Stearyl 2-ethyl hexanoate | SEH | 26 |

EXAMPLE 3

Hydrolysis of Neat Esters at 130° C.

By 'neat' it is meant that the esters were not incorporated into a metalworking fluid formulation. A comparison of the hydrolytic stability of three different alpha branched esters of the invention (based on 2-ethyl hexanoic acid) and of isopropyl oleate (IPO) was made. IPO is a hindered ester conventionally used in metalworking fluids to provide very good hydrolytic stability. See, e.g., Burgo, Kennedy, Oberle "Metalworking's Watery Challenge" Lubes'N' Greases, October 2001, p. 31. For purposes of this comparison IPO was obtained from Inolex Corporation, Philadelphia, Pa., U.S.A., under the trade name LEXOLUBE® IPO.

First, water 2000 ppm was added to each of the four esters (neat). An aliquot of each of the wet esters was sealed in a test tube. Each tube was placed in an oven maintained at 130° C. for a test period of twenty five days. Periodically, samples were removed from each test tube and titrated to determine the acid value of each of the samples. Using the acid value data obtained in this manner, the rate of hydrolysis in each sample was qualitatively assessed. An ester that is more resistant to hydrolysis will show less increase in acid value over the testing period. The results of the experiment with each of the four selected esters, IPO, MES, PEH, and SEH are shown in Table III, below:

TABLE III

Acid value of esters (mg KOH/g) after aging at 130° C.

| Time (days at 130° C.) | IPO Acid Value | MES Acid Value | PEH Acid Value | SEH Acid Value |
|---|---|---|---|---|
| 0 | 0.09 | 0.01 | 0.06 | 0.01 |
| 1 | 0.25 | 0.08 | 0.20 | 0.08 |
| 5 | 0.54 | 0.11 | 0.27 | 0.13 |
| 8 | 0.64 | 0.26 | 0.33 | 0.12 |
| 11 | 0.87 | 0.20 | 0.31 | 0.14 |
| 14 | 1.15 | 0.30 | 0.40 | 0.20 |
| 18 | 1.28 | 0.28 | 0.39 | 0.20 |
| 25 | 1.85 | 0.33 | 0.37 | 0.24 |

As can be seen from Table III, IPO showed an acid value increase over twenty five days at 130° C. of 1.76. In contrast, under the same conditions, the acid values of the esters of the invention (2-ethyl hexanoic acid-based esters) increased merely by 0.32 (PEH), 0.31 (PEH), and 0.23 (SEH). It is apparent from this data that the three esters of the invention PEH, PEH, and SEH were more resistant to hydrolysis than the conventional ester, isopropyl oleate, as their acid values over time showed a lesser increase than the acid values of IPO over time.

EXAMPLE 4

Hydrolysis of Neat Esters at 180° C.

The experiment carried out in Example 3 was repeated. All experimental conditions remained the same, with the exception that the temperature at which the aging was accomplished was elevated to 180° C. to further accelerate any hydrolysis reactions, and data were taken over a testing period of fourteen days. The results of the comparative experiment are shown below in Table IV.

TABLE IV

Acid value of esters (mg KOH/g) after aging at 180° C.

| Time (days at 180° C.) | IPO Acid Value | MES Acid Value | PEH Acid Value | SEH Acid Value |
|---|---|---|---|---|
| 0 | 0.14 | 0.08 | 0.14 | 0.10 |
| 1 | 0.51 | 0.19 | 0.27 | 0.18 |
| 3 | 1.23 | 0.30 | 0.45 | 0.27 |
| 7 | 4.10 | 0.43 | 0.55 | 0.26 |
| 14 | 4.47 | 0.33 | 0.67 | 0.29 |

As can be seen from Table IV, IPO showed an acid value increase of 4.33 over fourteen days at 180° C. In contrast, the acid values of the esters of the invention increased merely by 0.25 (PEH), 0.53 (PEH), and 0.19 (SEH). Thus, the three esters of the invention were more resistant to hydrolysis than the convention ester, isopropyl oleate, as their acid values over time showed a lesser increase than the acid value of IPO.

EXAMPLE 5

Hydrolytic Stability of Esters Incorporated in a Metalworking Fluid

The hydrolytic stabilities of an alpha branched ester of the invention and the conventional esters methyl lardate (MES) and IPO when incorporated into an aqueous metalworking fluid were compared by evaluation in the change of pH of each of the ester-containing formulations over time. Methyl lardate is a methyl ester of fatty acids derived from lard which generally have a distribution of saturated and unsaturated fatty acids with about twelve to about twenty carbon atoms, and is used in the art as an additive to rolling oils and metal working fluids.

First, four test formulations of a soluble oil-type metalworking fluid were prepared. The formulas of the formulations were standard soluble oil-type metalworking fluids with the exception that each formulation had incorporated into it one of IPO, MES, or PEH. The test formulation used is shown below in Table V:

TABLE V

Metalworking Fluid Formulation

| Ingredient | Amount |
|---|---|
| Water | 80 grams |
| Mineral oil | 15 grams |
| Test ester (one of IPO, MES, or PEH) | 2 grams |
| MAYSOL ® 767 | 3 grams |

MAYSOL® 676 is sulphonate-containing emulsifier package of a proprietary formulation that is commercially available from Mayco Oil & Chemical Co., Warminster, Pa., U.S.A. As discussed above, one standard empirical test for evaluating the chemical stability of an ester-containing metalworking fluid is to evaluate a change in pH over time. A decrease in pH is indicative of degradation of the ester by hydrolysis. The MAYSOL® 767 acts as a buffering agent. Because the system is buffered, one would expect only a minor change in the pH of the metalworking fluids tested.

To carry out the comparison, the samples were aged at 57° C. between pH measurements. Because soluble oils tend to form a bulk liquid phase with a highly concentrated cream phase on top, the samples were well mixed before measuring pH, and, at the end of the experiment, the acid values of each of the 'cream' phase and the bulk liquid phases were measured. The results obtained are shown below in Table VI:

TABLE VI pH Values Over Time

| Days at 57° C. | IPO system pH | MES system pH | PEH system pH |
|---|---|---|---|
| 0 | 9.19 | 9.20 | 9.19 |
| 7 | 9.05 | 9.03 | 9.05 |
| 14 | 8.96 | 8.99 | 9.01 |
| 21 | 8.98 | 9.05 | 9.08 |
| 28 | 9.00 | 8.99 | 9.04 |
| 35 | 9.02 | 9.06 | 9.11 |

TABLE VI-continued

| pH Values Over Time | | | |
|---|---|---|---|
| Days at 57° C. | IPO system pH | MES system pH | PEH system pH |
| 41 | 9.01 | 9.02 | 9.08 |
| 49 | 8.96 | 8.97 | 9.03 |
| 56 | 8.95 | 8.95 | 9.00 |
| acid value of bulk phase | 0.73 | 0.90 | 0.81 |
| acid value of cream phase | 2.38 | 2.93 | 0.77 |

As expected, the numerical difference in pH showed only a modest benefit for the more hydrolytically stable alpha branched ester (PEH) system, most likely because of the added buffering agents. With out wishing to be bound by theory, the inventors hypothesize that the mixing of the bulk and cream phases may interfere with the calibration of the pH meter from week to week. However, the acid value of the bulk and cream phases shows clearly that the PEH system is undergoing less degradation than the other ester systems.

EXAMPLE 6

Hydrolytic Stability of Esters Incorporated in a Metalworking Fluid

The hydrolytic stabilities of the alpha branched esters of the invention and the conventional ester IPO when formulated into aqueous metalworking fluids were compared by evaluation in the change of pH of each of the ester-containing formulations over time.

First, test formulations of a semi-synthetic type metalworking fluid was prepared. The formula of the formulation was a standard semi-synthetic type metalworking fluid formula, with the exception that each of the three formulations incorporated one of IPO, MES, or PEH. The formulation is shown below in Table VII:

TABLE VII

| Metalworking Fluid Formulation | |
|---|---|
| Ingredient | Amount |
| Water | 89 grams |
| Test ester (one of IPO, MES, or PEH) | 2 grams |
| MAYSOL ® SSD-50 | 9 grams |

MAYSOL® SSD-50 is a semi-synthetic base of a proprietary formulation that contains a biocide, corrosion inhibitors and wetting agents. It is commercially available from Maysol Oil & and Chemical, Warminister, Pa., U.S.A. Again change in pH over time was assessed as an indicator of the degradation of the ester that is attributable to hydrolysis. Similar to the formulation above, the MAYSOL® SSD-50 contains ingredients that buffer the system. Therefore, one would expect the pH change over time to be relatively small.

The samples were aged at 57° C. between measurements. Semi-synthetic fluids also form a bulk liquid phase with a highly concentrated cream phase on top. Samples were well mixed before measuring pH, and at the end of the experiment, the pH of the "cream" phase and the bulk liquid phase as measured. The results are shown in Table VIII:

TABLE VIII

| pH Values Over Time | | | |
|---|---|---|---|
| Days at 57° C. | IPO system pH | MES system pH | PEH system pH |
| 0 | 10.20 | 10.21 | 10.18 |
| 7 | 10.02 | 10.04 | 10.06 |
| 14 | 9.87 | 9.82 | 9.88 |
| 21 | 10.01 | 9.93 | 9.98 |
| 28 | 9.85 | 9.84 | 9.91 |
| 35 | 9.97 | 9.92 | 10.00 |
| 41 | 9.98 | 9.90 | 9.99 |
| 49 | 9.84 | 9.75 | 9.88 |
| 56 | 9.84 | 9.71 | 9.88 |
| acid value of bulk phase | 3.16 | 3.22 | 2.80 |
| acid value of cream phase | 2.87 | 2.92 | 1.75 |

Again the numerical difference in pH showed only a moderate benefit for the more hydrolytically stable alpha branched ester system (PEH). Without wishing to be bound by theory, it is believed that the presence of the bulk and cream phases may interfere with the calibration of the pH meter from week to week. However, the acid value of the bulk and cream phases shows clearly that the PEH system is undergoing less degradation than the others in semi-synthetic fluids as well.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A metalworking fluid comprising water and a metalworking concentrate, wherein the metalworking concentrate comprises an alpha branched ester represented by the formula (I):

(I)

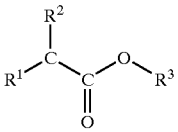

wherein $R^1$, $R^2$, and $R^3$ are each independently selected from a hydrocarbon group having one to thirty-six carbon atoms.

2. The fluid of claim 1, wherein the metalworking concentrate further comprises a hydrocarbon oil.

3. The fluid of claim 2, wherein the hydrocarbon oil is selected from the group consisting of a mineral oil, linseed oil, cutting oil, and petroleum oil.

4. The fluid of claim 1, wherein the water is present in an amount of about 70% to about 99% by weight of the total metalworking fluid.

5. The fluid of claim 1, wherein the water is present in an amount of about 80% to about 90% by weight of the total metalworking fluid.

6. The fluid of claim 1, wherein the metalworking concentrate is present in an amount of about 1% to about 30% by weight of the total metalworking fluid.

7. The fluid of claim 1, wherein the metalworking concentrate is present in an amount of about 10% to about 20% by weight of the total metalworking fluid.

8. The fluid of claim 2, wherein the metalworking concentrate comprises the hydrocarbon oil in an amount of about 0 to about 90% by weight of the total metalworking concentrate.

9. The fluid of claim 2, wherein the metalworking concentrate comprises the hydrocarbon oil in an amount of about 50% to about 80% by weight of the total metalworking concentrate.

10. The fluid of claim 1, wherein the metalworking concentrate comprises the alpha branched ester in an amount of about 1% to about 90% by weight of the total metalworking concentrate.

11. The fluid of claim 1, wherein the metalworking concentrate comprises the alpha branched ester in an amount of about 5% to about 70% by weight of the total metalworking concentrate.

12. A method of preparing a metalworking fluid comprising mixing water with an alpha branched ester represented by the formula (I):

(I)

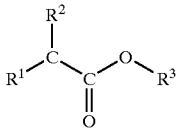

wherein $R^1$, $R^2$, and $R^3$ are independently selected from a hydrocarbon group having one to thirty-six carbon atoms.

13. The method of claim 12, further comprising mixing a hydrocarbon oil with the water and the alpha branched ester.

14. A method for preparing a metalworking fluid having an improved operating life, comprising mixing water with an alpha branched ester represented by the following formula (I):

(I)

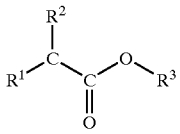

wherein $R^1$, $R^2$, and $R^3$ are independently selected from a hydrocarbon group having one to thirty-six carbon atoms, wherein the fluid exhibits improved operating life.

15. The method of claim 14, further comprising mixing a hydrocarbon oil with the water and the alpha branched ester.

* * * * *